United States Patent [19]

Grzina

[11] Patent Number: 4,984,966

[45] Date of Patent: Jan. 15, 1991

[54] METHOD OF MAKING LINER

[75] Inventor: Anthony Grzina, Artarmon, Australia

[73] Assignee: Warman International Limited, Australia

[21] Appl. No.: 353,664

[22] PCT Filed: Sep. 15, 1988

[86] PCT No.: PCT/AU88/00358

§ 371 Date: May 31, 1989

§ 102(e) Date: May 31, 1989

[87] PCT Pub. No.: WO89/02534

PCT Pub. Date: Mar. 23, 1989

[30] Foreign Application Priority Data

Sep. 15, 1987 [AU] Australia ..... PI4385

[51] Int. Cl.[5] ..... F04D 7/04; F04D 29/42

[52] U.S. Cl. ..... 29/888.061; 415/197; 415/170.1

[58] Field of Search ..... 415/196, 197, 173.1, 415/170.1, 173.6, 126; 29/156.4 R, 156.4 WL

[56] References Cited

U.S. PATENT DOCUMENTS

| | | | |
|---|---|---|---|
| 914,283 | 3/1909 | Jackson | 415/196 |
| 1,727,703 | 9/1929 | Hause et al. | 415/196 |
| 2,414,931 | 1/1947 | Colwell et al. | 29/156.4 R |
| 2,690,131 | 9/1954 | Butler | 415/196 |
| 2,800,084 | 2/1957 | Butler | 415/196 |
| 3,018,736 | 1/1962 | Clay | 415/206 |
| 3,149,574 | 9/1964 | Mill | 415/214.1 |
| 3,381,617 | 5/1986 | Wright | 415/197 |
| 3,938,908 | 2/1976 | DeBree | 415/196 |

FOREIGN PATENT DOCUMENTS

| | | | |
|---|---|---|---|
| 141389 | of 0000 | U.S.S.R. | 415/197 |

*Primary Examiner*—Edward K. Look
*Assistant Examiner*—Hoang Nguyen
*Attorney, Agent, or Firm*—Amster, Rothstein & Ebenstein

[57] ABSTRACT

A liner for a centrifugal pump of the type made from wear resistant metal is conventional made with a step (5) in the inner surface of the liner between the junction of the side liners (2 and 3) and the volute liner (1), because of the difficulty in machining the hydraulic surface of the liner. This step (5) causes localized accelerated wear. The liner of the present invention is made with a thickening (11) of the area adjacent the joint with the side liners (2 and b 3) which thickening protrudes inwardly beyond the inner surface of the side liners (2 and 3). Upon assembly the thickening (11) is reduced to align with the inner surface of the side liners (2 and 3), to reduce localized wear on the liner.

3 Claims, 4 Drawing Sheets

METHOD OF MAKING LINER

The present invention relates to an improved centrifugal pump and in particular to an improved liner construction for centrifugal slurry pumps and method of construction thereof and particularly to centrifugal slurry pumps wherein because of their method of construction a sharp discontinuity occurs on the inner surface because of the mating of the liner components.

As these pumps are used in slurry applications, hard metal or elastomeric liners are necessary to minimise wear. As the metal and elastomeric liners are required to be interchangeable, it is necessary to make the liners of different materials with the same internal "hydraulic" shape, so that performance does not change when liners are changed.

With hard metal liners, the only available method to conform the liner to the required dimensions until recently was by means of grinding. Grinding is slow and costly and is confined to flat surfaces, readily accessible to large grinding wheels. Therefore the grinding of excess materials from hard metal liners was restricted to the minimum.

Hard metal parts made from a casting process are difficult to control dimensionally, particularly when cores are used, as cores can shift and cause variations in casting thickness. As it is necessary that the liner and its parts must fit exactly within required tolerances in the casing as shown in FIG. 3, the outer surfaces 16 of the volute liner 1 and the outer surface 15 and 17 respectively of the throat bush 2 and frame plate liner insert 3 (as shown in FIG. 1 and 2) are machined to the required width.

In FIG. 2 is shown a close-up of the fitting of the throat bush 2 and the volute liner 1 in the prior art pump shown in section view in FIG. 3. Because the parts are produced as cast metal liners or as moulded elastomeric liners as is required by the medium to be pumped, it is necessary that the mating surfaces 6 and 7 of both the volute liner 1 and the throat bush 2 are produced to smooth finish to ensure accurate fitting of the mating parts. Further to fit the liners into the pumps the outer surfaces 15 and 16 are machined. The inner surfaces of the liner are not machined.

Because of the above considerations, it is extremely difficult to cast two separate hard metal parts such as a volute and throat bush which, when ground and fitted together, have the inside surfaces matching exactly.

As it was not practical to make the liner parts'inner surfaces flush, the side liners (i.e. throat bush 2 and frame plate liner insert 3) were allowed to protrude further inwards than the inside surface 8 of the volute liner 1 as shown in FIG. 1 to 4. This configuration is preferable from a wear point of view than having the inside liners thinner than the volute liner as shown in FIG. 5.

In order that elastomeric lined pumps have the same performance as metal lined pumps, the elastomeric liners are produced with the same internal shape as the metal liners, although the rubber liners can be moulded to very much closer tolerances than metal liners.

It is known that, when slurries or liquids having entrained solids are pumped, the solids can cause wear on the parts of the pumps. Eddying and unwanted turbulence are formed near areas of the pump casing or liner which have abrupt discontinuity, such as steps, of the surface profile. This problem is particularly associated with the mating of the throat bush and the volute liner, and the mating of frame plate liner insert and the volute liner in pumps where components are metal (e.g., cast metal) and the respective mating surfaces require machining or the like. As shown in FIGS. 1 to 4 there is a discontinuity 4 in the form of a step 5 on the inner surface of the liner between the volute liner 1 and the throat bush 2 and between the volute liner 1 and the frame plate liner insert 3 in prior art centrifugal slurry pumps.

This discontinuity causes eddying and turbulence around the step 5 with consequential abrasion by the entrained solids of the volute liner and side liners, producing a high wear area, as shown in FIG. 6. The flow leaving the pump impeller enters the internal pump passageway, but because of the step 5 on the side liners 2 and 3, eddies can cause a concentration of wear at the step 5 and subsequent wear on the joint faces as shown. Thus the volute liner fails prematurely and only in a localised area near the joints between the side liners and the volute liner.

Because of recent advances in manufacturing techniques, machining of hard metals is now not confined to grinding. Hard metals can be machined by using special tooling on standard turning/boring machines.

The present invention seeks to ameliorate the above disadvantages.

In one period form the invention comprises a liner for a centrifugal slurry pump comprising:

a throat bush having an inner surface;

a volute liner having an inner surface; and a frame plate liner insert having an inner surface, wherein said throat bush and said frame plate liner insert each mate in a respective opening in said volute liner and wherein the volute liner has a wall thickening at and adjacent the respective openings so that the said volute liner has its inner surfaces projecting inwardly at said opening of the inner surfaces of the said throat bush and said frame plate liner insert, when said volute liner, said throat bush and said frame plate liner insert are assembled and wherein said wall thickening of said volute liner at and adjacent said respective openings is reduced such that said inner surfaces of the volute liner and throat bush and said inner surfaces of the volute liner and the frame plate liner insert are substantially aligned at the area of the opening.

The present invention will now be described by way of example with reference to the accompanying drawings, in which.

Figure 1:
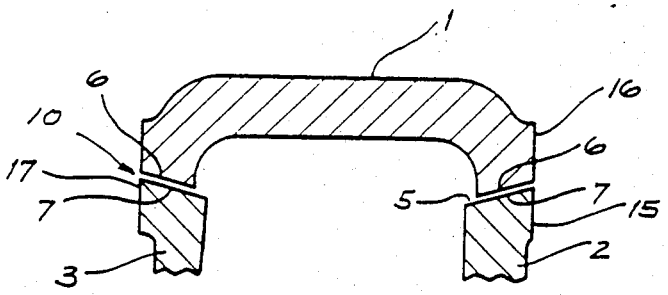
FIG. 1 PRIOR ART
FIGS. 1–6 illustrate fragmentary cross-sectional views of prior art liners.
Figure 2:
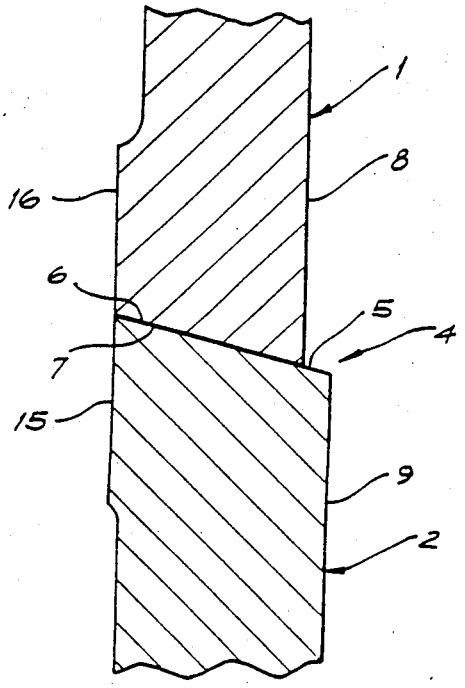
FIG. 2 PRIOR ART
Figure 3:
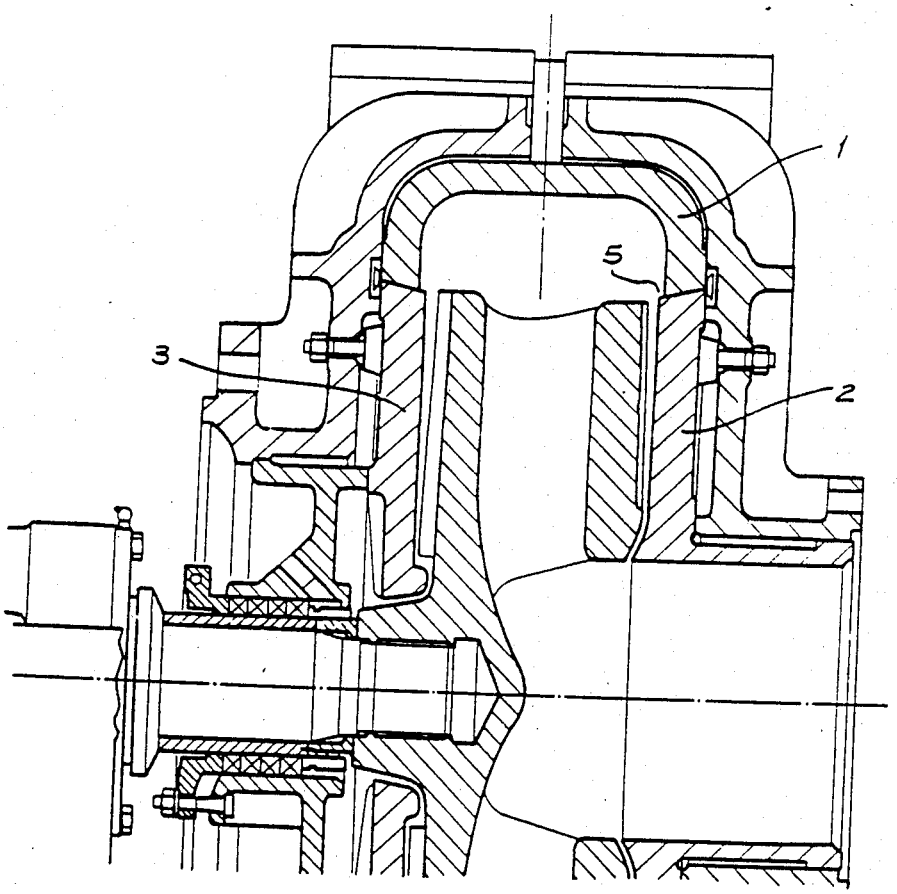
FIG. 3 PRIOR ART
Figure 4:
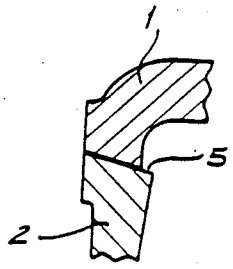
FIG. 4 PRIOR ART
Figure 5:
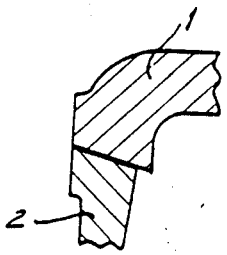
FIG. 5 PRIOR ART
Figure 6:
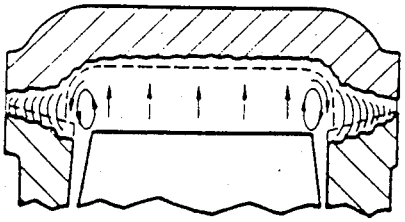
FIG. 6 PRIOR ART

As mentioned previously, because the sealing faces and the back faces of the volute liner, the throat bush and the frame plate liner insert have to be machined to ensure accurate fit therebetween and accurate fit in the pump casing, it is difficult to align the inner faces or surfaces 8 and 9, and hence a discontinuity with its resultant step 5 occurs (see FIG. 2).

Figure 7:
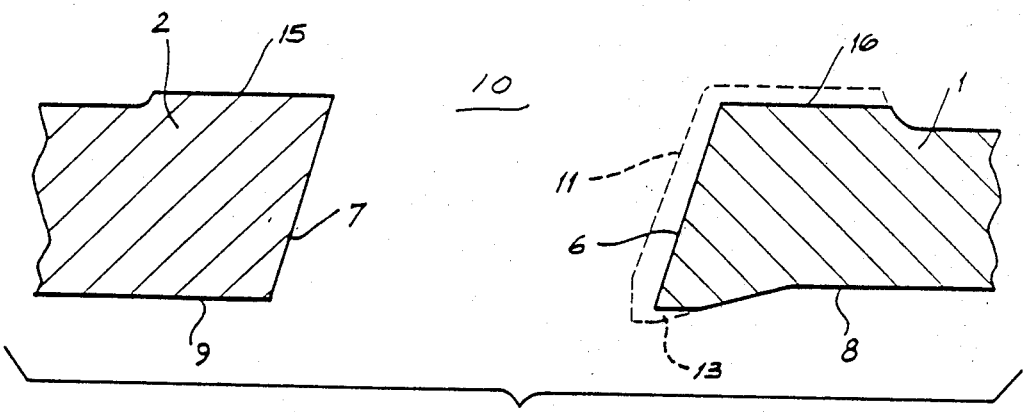
FIG. 7 illustrates a detail of a cross-section of the volute liner at its opening according to one embodiment of the present invention.

As shown in FIG. 7, according to the present invention the area of the opening 10 of the volute liner is cast with a thickened protrusion 11 (as shown by dotted lines).

The mating faces or surfaces 6 and 7 and the back faces 15 and 16 of the volute liner and throat bush are machined to the required degree such that the parts fit together in sealing relationship. This leaves a small projection 13 on the inner surface of the volute liner 1.

Figure 8:
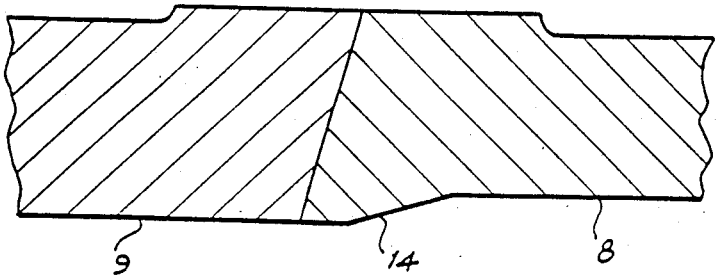
FIG. 8 illustrates the mating of the above volute liner with a throat bush with the components suitably ground to the required sizes.
Figure 9:
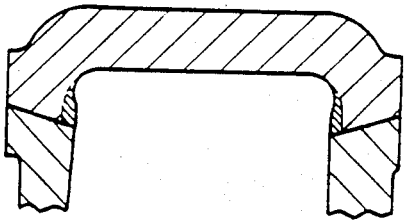
FIG. 9 illustrates a cross-sectional view of the mating of the above volute liner with both side liners.

This is then removed when the final fitting of the throat bush to the liner has occurred to form a smooth transition 14 from the inner surface 9 of throat bush 2 to the inner surface 8 of the volute liner 1, as shown in FIG. 8 without weakening the liner due to reduction in thickness. A similar procedure is carried out with frame plate liner insert opening to produce an alignment as shown in FIG. 9.

Figure 10:
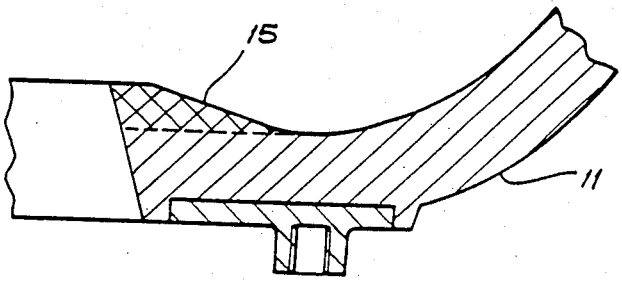
FIG. 10 illustrates the area of the opening in an elastomeric volute liner to receive the throat bush.

A similar shaped thickening 15 is used with elastomeric volute liners 11 as shown in FIG. 10.

However, as elastomeric material can be moulded more accurately than hard metal, no machining is necessary. Thus the volute liner has been thickened adjacent its joint with the side liners producing a smooth alignment of the volute liner and side liners inner surfaces.

It should be obvious to people skilled in the art that variation and modifications can be made to the above without departing from the scope or the spirit of the present invention.

I claim:

1. A method of assembly a liner for a centrifugal slurry pump comprising;

(i) a throat bush having an inner surface and an outer surface;

(ii) a volute liner having an inner surface and an outer surface and two opposed openings, the volute liner having a wall thickening surrounding each opening on the inner surface of said volute liner; and (iii) a frame plate liner insert having an inner surface and an outer surface;

said method comprising the steps of:

(A) inserting the throat bush into one of the openings of the liner into its assembled position, whereby the volute liner has the respective wall thickening projecting inwardly at the one opening beyond the inner surface of the throat bush;

(B) reducing the inner surface of the volute liner adjacent the one opening until the inner surfaces of the volute liner and throat bush are substantially aligned around the one opening;

(C) inserting the frame plate liner insert into the other of the openings of the volute liner into its assembled position, whereby the volute liner has its respective wall thickening projecting inwardly at the other opening beyond the inner surface of the frame plate liner insert; and (D) reducing the inner surface of the volute liner adjacent the other opening until the inner surfaces of the volute liner and frame plate liner insert are substantially aligned around the other opening.

2. The method of claim 1 comprising the additional steps of machining the outer surfaces of the volute liner, throat bush and frame plate liner insert such that the liner is of sufficient width to fit within a casing of the pump.

3. The method of claim 2 wherein the throat bush, volute liner, and frame plate liner insert are made of hard metal.

* * * * *